United States Patent [19]

Pritchard

[11] Patent Number: 5,044,818

[45] Date of Patent: Sep. 3, 1991

[54] ADJUSTABLE MANHOLE COVER ASSEMBLY

[76] Inventor: Phillip C. Pritchard, 131B Davis St., Asheboro, N.C. 27203

[21] Appl. No.: 557,580

[22] Filed: Jul. 24, 1990

[51] Int. Cl.[5] ..... E02D 29/14

[52] U.S. Cl. ..... 404/26; 404/25

[58] Field of Search ..... 404/26, 25; 52/20, 19

[56] References Cited

U.S. PATENT DOCUMENTS

| | | | |
|---|---|---|---|
| 599,457 | 2/1898 | Sanborn . | |
| 1,257,324 | 2/1918 | Daniels . | |
| 3,237,538 | 3/1966 | McPheeters et al. | 404/26 |
| 3,240,133 | 3/1966 | Binette | 94/34 |
| 3,331,295 | 7/1967 | Sorrell | 94/34 |
| 3,926,533 | 12/1975 | Binette | 404/26 |
| 4,143,988 | 3/1979 | Arment | 404/26 |
| 4,158,515 | 6/1979 | Helms | 404/26 |
| 4,197,031 | 4/1980 | Hild | 404/26 |
| 4,337,005 | 6/1982 | LeBaron | 404/26 |

FOREIGN PATENT DOCUMENTS

| | | | |
|---|---|---|---|
| 0317189 | 11/1988 | European Pat. Off. | 404/26 |
| 2260383 | 12/1972 | Fed. Rep. of Germany | 404/26 |

*Primary Examiner*—Ramon S. Britts

*Attorney, Agent, or Firm*—Richard E. Jenkins

[57] ABSTRACT

A vertically adjustable manhole cover assembly providing for ease of vertical adjustment and stable support of the manhole cover subsequent to roadway resurfacing. The manhole cover assembly utilizes annular adjustment rings at both the bottom and top of a vertically adjusted annular sleeve positioned within the annular frame of the manhole cover assembly for support of the manhole cover. The upper annular support ring includes an annular flange extending radially outwardly beyond the annular frame which is captured by the roadway resurfacing material so as to provide additional support to the vertically adjustable manhole cover assembly after road resurfacing.

10 Claims, 4 Drawing Sheets

ADJUSTABLE MANHOLE COVER ASSEMBLY

DESCRIPTION

1. Technical Field

The present invention relates to manhole covers of the type widely used in roadway construction. More particularly, the invention relates to a vertically adjustable manhole cover which may be easily raised during roadway resurfacing to conform the top surface of the cover to the new level of the roadway and which provides enhanced stability to the top surface of the newly adjusted manhole cover.

2. Background Art

As is well known, most paved streets have water lines, sewer lines and various types of electrical lines therebeneath. In order to gain access to these underground facilities for inspection and servicing, an access tunnel extends from the underground facilities upwardly to the street level where it is covered with a manhole cover or the like that is flush with the road surface. In this fashion, vehicle travel over the road surface and manhole cover therein is relatively smooth and road vibrations are reduced to a minimum. Unfortunately, when it is necessary to resurface the street with a new layer of resurfacing material such as asphalt, the manhole cover must be vertically raised in order to be flush or parallel with the new resurfaced street level. The elevation of conventional manhole covers involves time-consuming digging-up of the old road surface in order to remove the buried manhole cover frame and then reinstallation of the frame on a suitable foundation so as to be elevated about 1 to 2 inches. Then, the area surrounding the manhole cover must be repaired prior to the final resurfacing operation.

Others have attempted to improve upon this conventional procedure for elevating manhole covers in conjunction with the roadway resurfacing process. For example, U.S. Pat. No. 3,331,295 to Sorrell discloses a manhole cover assembly of the type having a fixed outer frame and a vertically adjustable inner sleeve for supporting the manhole cover. The inner sleeve may be elevated by positioning a ring at the base of the frame and then repositioning the manhole cover support sleeve thereon. Another representative attempted solution to the conventional manhole adjustment procedure is disclosed in U.S. Pat. No. 4,158,515 to Helms. This patent teaches the use of a cylindrical extension element which is positioned on top of the fixed frame so as to support the manhole cover in a vertically elevated position.

Although the art includes many other patents directed to efforts to provide an improved adjustable manhole cover, the two aforementioned patents are believed to be generally representative. Unfortunately, none of these constructions have been entirely satisfactory for a variety of reasons including expense, complexity, and unsatisfactory performance. For example, applicant is aware of manhole cover frames which have been vertically elevated by placement of an annular extension element on the top thereof for supporting the manhole cover and which tend to warp due to the vehicular traffic. The warping of the extension element has the dangerous result of causing the manhole cover supported thereby to have a propensity to be thrown into air and cause the potential for significant damage to nearby vehicles and individuals. Thus, there is a long-felt need for a vertically adjustable manhole which overcomes the shortcomings of the prior art constructions.

DISCLOSURE OF THE INVENTION

In accordance with the present invention, applicant provides an improved vertically adjustable manhole cover assembly which is easy to assemble and provides enhanced stability in order to obviate the potential danger of manhole covers becoming dislodged and thrown into the air so as to endanger nearby vehicles and individuals. The vertically adjustable manhole cover assembly comprises a fixed annular frame member having an upper rim surface adapted to be placed so as to be substantially flush with the surface of a roadway, and defining an upper annular shoulder support surface located inwardly and below the upper rim surface and a lower annular shoulder support surface vertically spaced-apart from the upper annular shoulder and located radially inwardly thereof. A vertically adjustable annular sleeve member is provided which is adapted to be slidably received within the fixed annular frame member so that the bottom surface thereof rests on the lower annular shoulder of the fixed annular frame member. The annular sleeve member further includes an outwardly extending annular flange around the top surface thereof which is adapted to rest on the upper annular shoulder support surface of the fixed annular frame member when it is slidably received therein.

A first annular adjustment ring is provided which is adapted to be slidably received within the fixed annular frame member and to rest on the lower annular shoulder thereof with the annular sleeve member resting thereon, and a second annular adjustment ring is provided which is adapted to rest on the upper rim surface and upper annular shoulder support surface of the fixed annular frame member with the annular flange of the annular sleeve member resting thereon. The second annular adjustment ring further includes a flange around the circumference thereof which extends radially outwardly beyond the fixed annular frame member so as to be embedded in the road resurfacing material. Finally, a manhole cover member is supported on the vertically adjustable annular sleeve member. In this fashion, the first and second annular adjustment rings are used to vertically raise the annular sleeve member and manhole cover member for roadway resurfacing, and the annular flange of the second annular adjustment ring will be embedded within the resurfacing material so as to help stabilize the annular sleeve member and manhole cover member supported thereby.

It is therefore the object of this invention to provide a new and improved vertically adjustable manhole cover.

It is a further object of this invention to provide a vertically adjustable manhole cover which allows for relative ease of elevation of the manhole cover for roadway resurfacing.

It is another object of the invention to provide a vertically adjustable manhole cover which possesses a high degree of strength and stability after elevation and thereby prevents the manhole cover from wobbling and/or being thrown into the air by vehicular traffic thereover.

Some of the objects of the invention having been stated, other objects will become evident as the description proceeds, when taken in connection with the accompanying drawings.

BEST MODE FOR CARRYING OUT THE INVENTION

Reference will now be made in detail to the present preferred embodiment of the invention, an example of which is illustrated in the accompanying drawings. Thus, referring now to FIGS. 1–4, it may be seen that the adjustable manhole cover assembly provides an easy and simple means for adjusting the vertical height of a manhole cover as well as providing subsequent stability in the support thereof so as to prevent wobbling and related problems. In accordance with the invention, manhole cover assembly 100 generally includes a fixed annular frame member 10 with an upper annular shoulder 10A located inwardly and below upper rim surface 10B, and a lower annular shoulder 10C located at the bottom of annular frame member 10. Lower annular shoulder 10C is located radially inwardly from upper annular shoulder 10A of annular frame member 10.

Vertically movable annular sleeve member 20 is provided to be slidably received within annular frame member 10 with the bottom surface thereof resting on lower annular shoulder 10C, and annular flange 20A thereof resting on upper annular shoulder 10A of annular frame member 10. Annular sleeve member 20 further defines an upper annular shoulder 20B therein which supports manhole cover member 30. This configuration of manhole cover assembly 100 which is used prior to roadway resurfacing is best understood with reference to FIG. 2 of the drawings. As can be fully appreciated, annular sleeve member 20 is supported at the top and bottom thereof by fixed annular frame member 10 so as to provide a stable support for manhole cover member 30 carried thereby.

Figure 1:
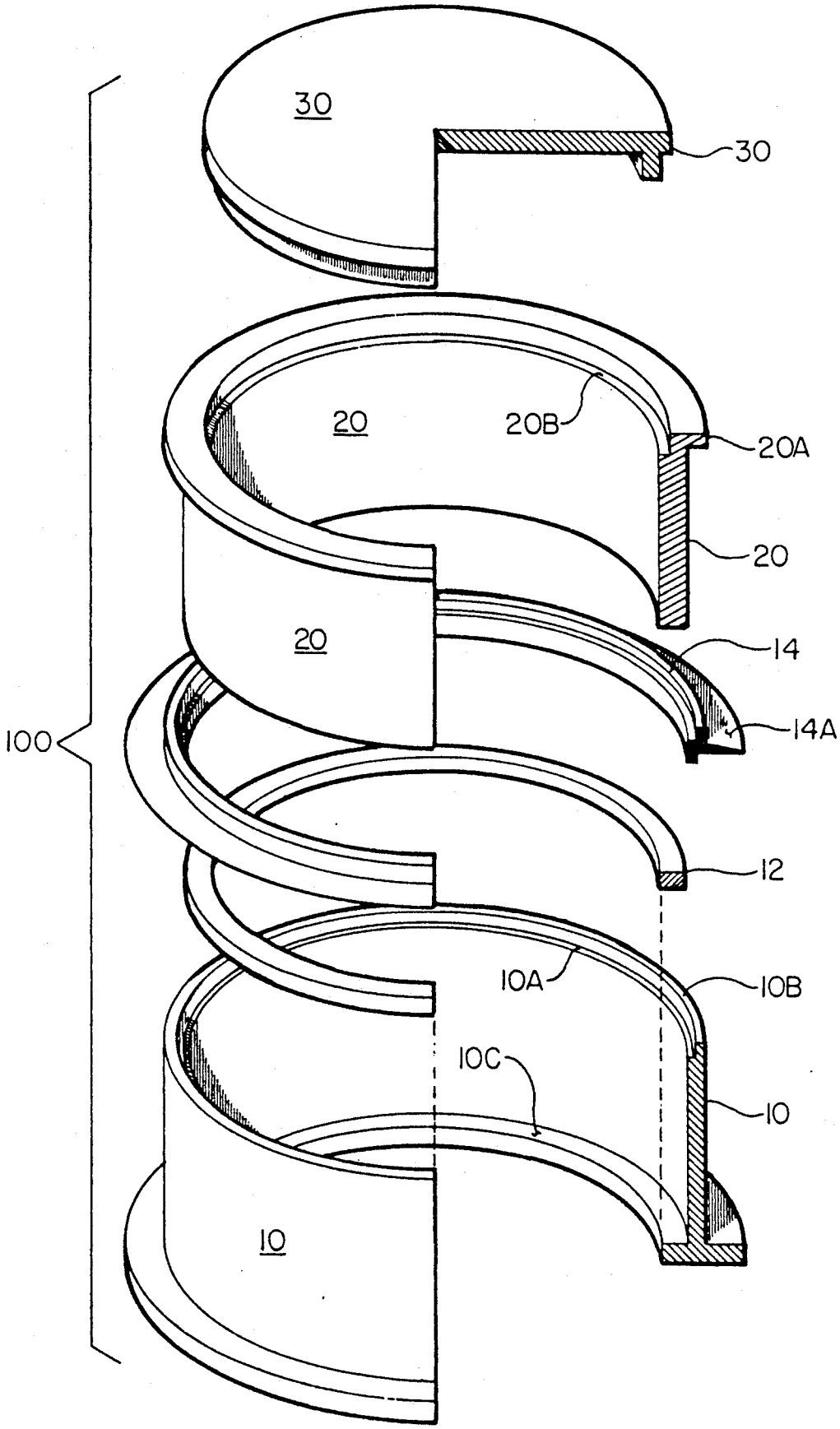
FIG. 1 is an exploded perspective view of the adjustable manhole cover assembly of this invention.
Figure 2:
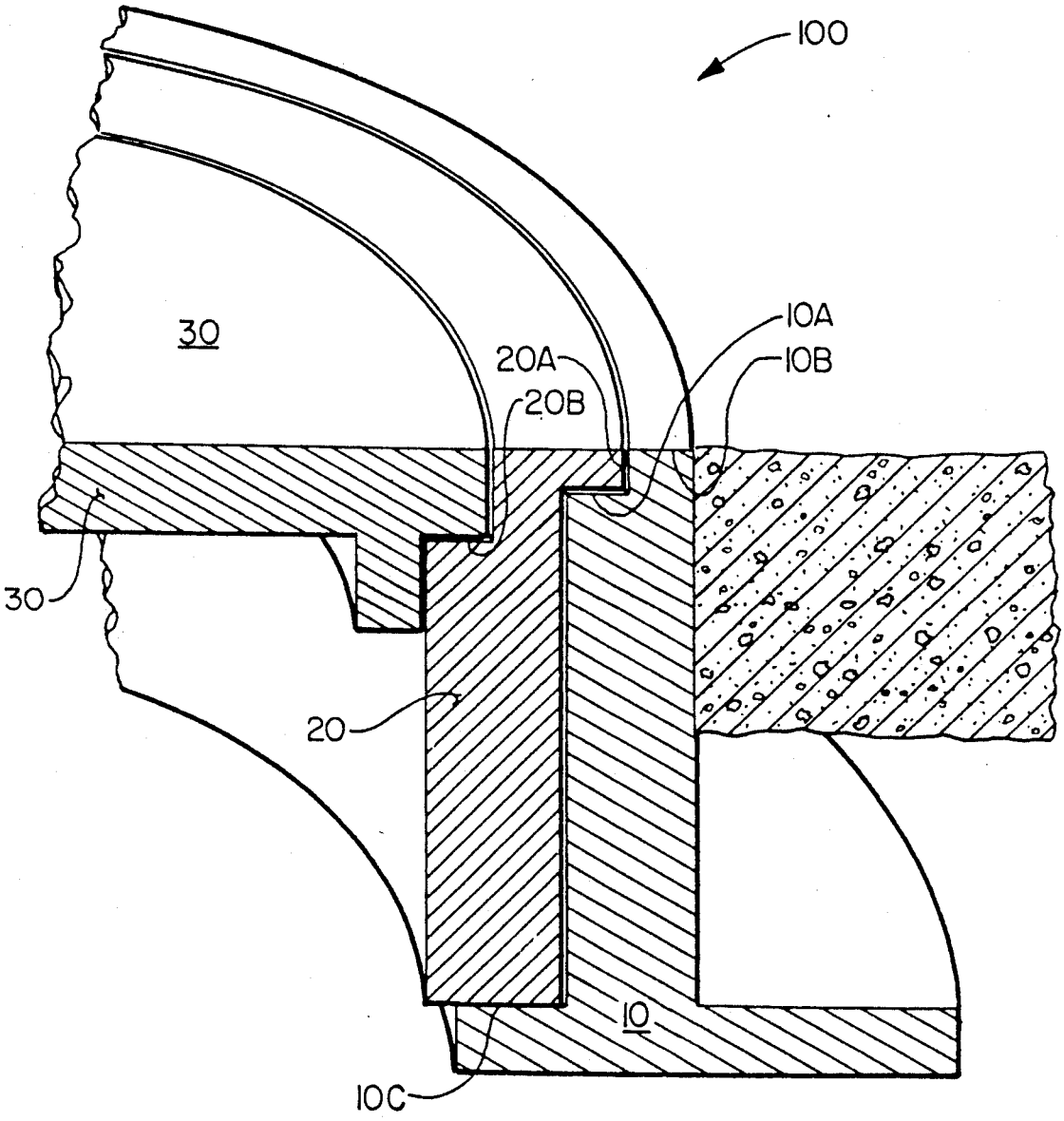
FIG. 2 is a fragmentary vertical cross-sectional view of the manhole cover assembly of this invention prior to roadway resurfacing.
Figure 3:
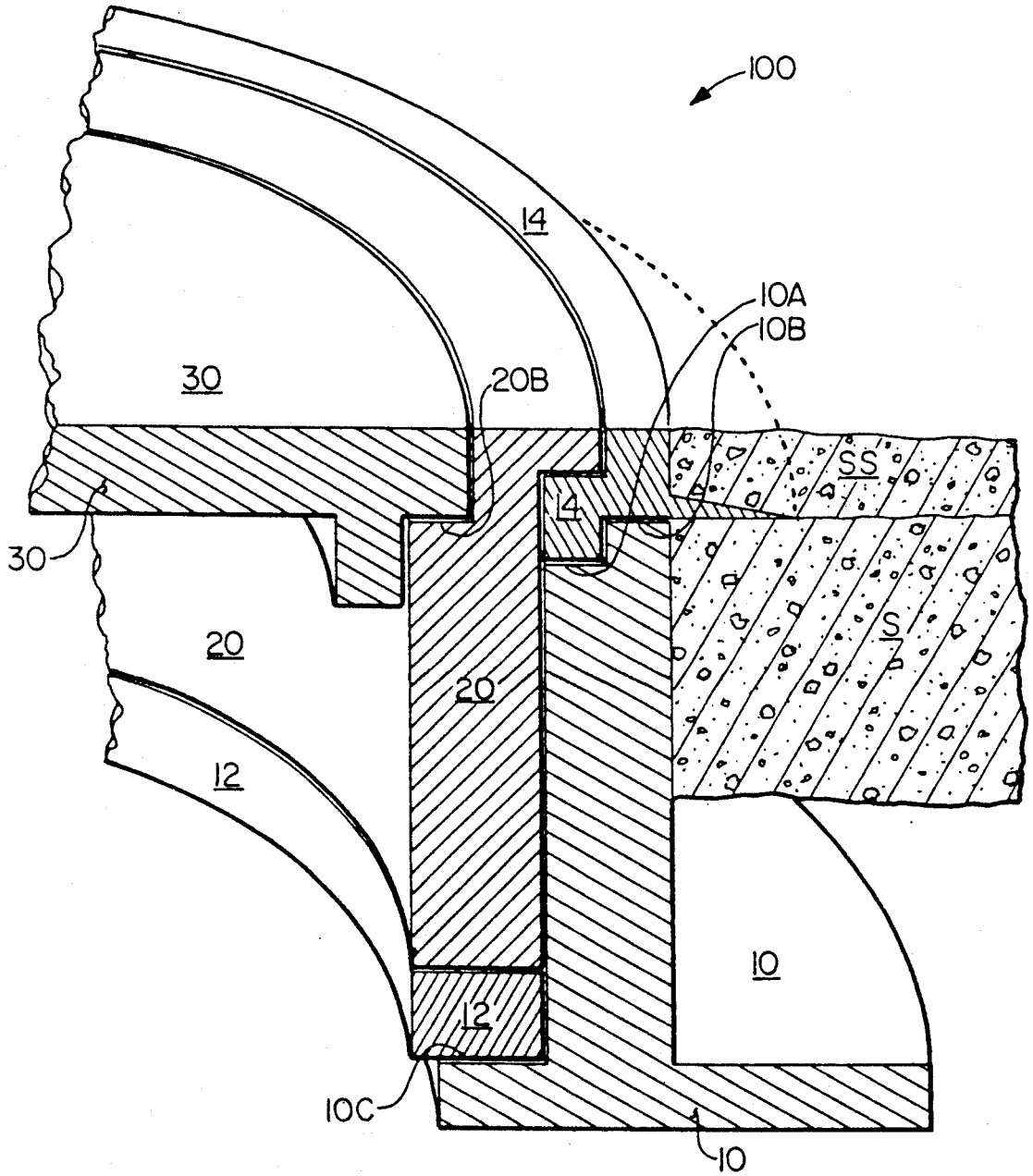
FIG. 3 is a fragmentary vertical cross-sectional view of the manhole cover assembly of this invention after a first roadway resurfacing.

Referring now particularly to FIG. 3, applicant will describe how manhole cover assembly 100 is modified so as to vertically raise manhole cover member 30 for a first roadway resurfacing. The original roadway surface is designated S for clarity of understanding. To elevate manhole cover member 30 so as to position it to be flush with the resurfaced portion SS of the roadway, one must simply remove annular sleeve member 20 and manhole cover member 30 resting thereon from fixed annular frame member 10. Next, first annular adjustment ring 12 (see also FIG. 1) is slidably positioned at the bottom of fixed annular frame member 10 so as to rest on lower annular shoulder 10C thereof. Second annular adjustment ring 14 is then positioned so as to rest on upper rim surface 10B and upper annular shoulder 10A of fixed annular frame member 10. Annular sleeve member 20 is then replaced within fixed annular frame member 10 so that annular flange 20A thereof rests on second annular adjustment ring 14 and the bottom surface thereof rests on first annular adjustment ring 12. By so supporting annular sleeve member 20 at the top and bottom thereof on second and first annular adjustment rings, 14 and 12 respectively, annular sleeve member 20 is provided with great stability and is thereby able to support manhole cover member 30 in a rigid fashion so as to prevent the manhole cover member from wobbling or being thrown upwardly into the air due to vehicular traffic over manhole cover assembly 100.

Also, second annular adjustment ring 14 includes an annular flange 14A extending generally radially outwardly therefrom beyond the outside circumferential surface of fixed annular frame member 10. Flange 14A is preferably tapered and serves to further stabilize second annular adjustment ring 14 subsequent to roadway resurfacing by being captured within the new resurface portion SS of the roadway (see FIG. 3). Thus, the addition of first annular adjustment ring 12 and second annular adjustment ring 14 to vertically raise the top surface of manhole cover member 30 prior to resurfacing of the roadway is a simple and expedient manner in which to vertically adjust manhole cover assembly 100 as well as to provide rigid support for manhole cover member 30.

Figure 4:
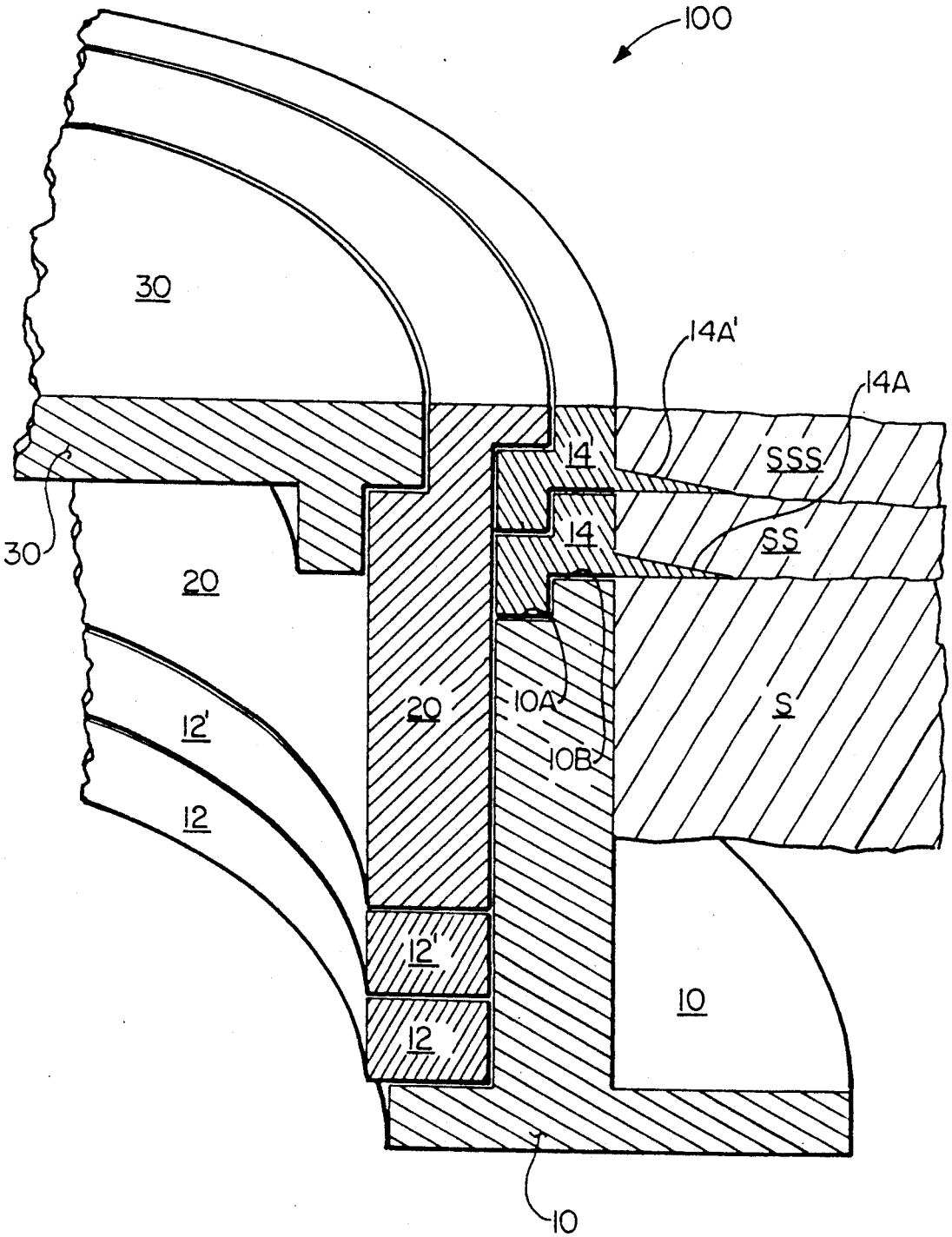
FIG. 4 is a fragmentary vertical cross-sectional view of the manhole cover assembly of this invention after a second roadway resurfacing.

With reference now to FIG. 4, the configuration of adjustable manhole cover assembly 100 can be understood when a second road surfacing is required so as to necessitate a second vertical adjustment of the manhole cover assembly. In order to vertically elevate manhole cover member 30 so as to be flush with new roadway resurfacing portion SSS, annular sleeve member 20 and manhole cover member 30 carried thereby are again temporarily removed and another first annular adjustment ring 12' is placed on first annular adjustment ring 12 and another second annular adjustment ring 14' is placed on original second annular adjustment ring 14. Then, annular sleeve member 20 and manhole cover member 30 are repositioned so as to rest on first annular adjustment ring 12' and second annular adjustment ring 14' in the same fashion as described hereinbefore for first and second annular adjustment rings, 12 and 14 respectively. Also, the annular flange 14A' of second annular adjustment ring 14' is captured by the second roadway resurfacing portion SSS in a similar fashion as annular flange 14A of second annular adjustment ring 14 was captured by first roadway resurfacing portion SS. Therefore, manhole cover assembly 100 lends itself to vertical adjustment for a second (as shown in FIG. 4) roadway resurfacing as well as additional roadway resurfacings when additional first and second annular adjustment rings (not shown) are added in the same fashion as shown in FIG. 4 of the drawings.

It will be understood that various details of the invention may be changed without departing from the scope of the invention. Furthermore, the foregoing description is for the purpose of illustration only and not for the purpose of limitation—the invention being defined by the claims.

What is claimed is:

1. A vertically adjustable manhole cover assembly comprising:

a fixed annular frame member having an upper rim surface adapted to be placed so as to be substantially flush with the surface of a roadway, and defining an upper annular shoulder support surface located inwardly and below said upper rim surface and a lower annular shoulder support surface vertically spaced apart from said upper annular shoulder and located inwardly thereof;

a vertically adjustable annular sleeve member defining a height less than the height of said fixed annular frame member adapted to be slidably received within said fixed annular frame member and for the bottom surface thereof to rest on said lower annular shoulder of said fixed annular frame member, said annular sleeve member further defining an outwardly extending annular flange around the top surface thereof adapted to rest on said upper annular shoulder support surface of said fixed annular frame member when slidably received therein wherein the bottom surface and annular flange of said annular sleeve member simultaneously rest on and are supported by the lower annular shoulder and upper annular shoulder, respectively, of said fixed annular frame member; and a manhole cover member supported on said vertically adjustable annular sleeve member.

2. A vertically adjustable manhole cover assembly according to claim 1 further including:

a first annular adjustment ring adapted to be slidably received within said fixed annular frame member and to rest on said lower annular shoulder thereof with said vertically adjustable annular sleeve member resting thereon, and a second annular adjustment ring adapted to rest on said upper rim surface and upper annular shoulder support surface of said fixed annular frame member with said annular flange of said vertically adjustable annular sleeve member resting thereon, said second annular ring defining a flange around at least a portion of the circumference thereof and extending radially outwardly beyond said fixed annular frame member.

3. A vertically adjustable manhole cover assembly according to claim 2 comprising two or more each of said first and second annular rings positioned within said fixed annular frame member in vertically stacked relationship.

4. A vertically adjustable manhole cover assembly according to claim 2 wherein said flange extends around the entire circumference of said second annular ring.

5. A vertically adjustable manhole cover assembly according to claim 4 wherein said flange extends radially outwardly about 1.50 inches beyond the output surface of said fixed annular frame member.

6. A vertically adjustable manhole cover assembly according to claim 4 wherein said flange defines a tapered cross section with the radially remote portion thereof having the least thickness.

7. A vertically adjustable manhole cover assembly according to claim 2 wherein said first and second annular rings raise the height of said vertically adjustable annular sleeve about 1.00 inch.

8. A vertically adjustable manhole cover assembly comprising:

a fixed annular frame having an upper rim surface adapted to be placed so as to be substantially flush with the surface of a roadway, and defining an upper annular shoulder support surface located inwardly and below said upper rim surface and a lower annular shoulder support surface vertically spaced apart from said upper annular shoulder and located inwardly thereof, a vertically adjustable annular sleeve member defining a height less than the height of said fixed annular frame member adapted to be slidably received within said fixed annular frame member and for the bottom surface thereof to rest on said lower annular should of said fixed annular frame member, said annular sleeve member further defining an outwardly extending annular flange around the top surface thereof adapted to rest on said upper annular shoulder support surface of said fixed annular frame member when slidably received therein wherein the bottom surface and annular flange of said annular sleeve member simultaneously rest on and are supported by the lower annular shoulder and upper annular shoulder, respectively, of said fixed annular frame member;

a first annular adjustment ring adapted to be slidably received within said fixed annular frame member and to rest on said lower annular shoulder thereof with said vertically adjustable annular sleeve member resting thereon and elevated about 1.00 inches thereby;

a second annular adjustment ring adapted to rest on said upper rim surface and upper annular shoulder support surface of said fixed annular frame member with said annular flange of said vertically adjustable annular sleeve member resting thereof and elevated about 1.00 inches thereby, said second annular ring defining a tapered flange around the circumference thereof and extending radially outwardly about 1.00–2.00 inches beyond said fixed annular frame member; and a manhole cover member supported on said vertically adjustable annular sleeve member;

whereby said first and second annular adjustment rings are used to vertically raise said annular sleeve member and manhole cover member for roadway resurfacing.

9. A vertically adjustable manhole cover assembly according to claim 8 comprising two or more each of said first and second annular rings positioned within said fixed annular frame member in vertically stacked relationship.

10. A vertically adjustable manhole cover assembly according to claim 8 wherein said flange of said second annular ring extends radially outwardly about 1.50 inches beyond the outside surface of said fixed annular frame member.

* * * * *